United States Patent [19]

Walters et al.

[11] 4,035,250

[45] July 12, 1977

[54] PRODUCTION OF PERFLUORO-N-HEPTANE

[75] Inventors: Harold C. Walters; William Ves Childs, both of Bartlesville, Okla.

[73] Assignee: Phillips Petroleum Company, Bartlesville, Okla.

[21] Appl. No.: 666,101

[22] Filed: Mar. 11, 1976

[51] Int. Cl.[2] ..... C25B 3/08; C07C 17/38; C07C 19/08

[52] U.S. Cl. ..... 204/59 F

[58] Field of Search ..... 204/59 F

[56] References Cited

U.S. PATENT DOCUMENTS

| | | | |
|---|---|---|---|
| 3,551,307 | 12/1970 | Gray | 204/59 F |
| 3,645,863 | 2/1972 | Stewart et al. | 204/59 F |
| 3,650,917 | 3/1972 | Ruehlen | 204/59 F |
| 3,840,445 | 10/1974 | Paul et al. | 204/59 F |
| 3,853,737 | 12/1974 | Childs | 204/270 |
| 3,882,001 | 5/1975 | Mills | 204/59 F |

*Primary Examiner*—F.C. Edmundson

[57] ABSTRACT

Perfluoro-n-heptane is produced by an electrochemical fluorination process comprising cooling the effluent from a first cell to a temperature sufficient to condense such effluent, separating a fluorocarbon-rich phase from the condensate, a second stage fluorination wherein partially fluorinated n-heptanes in the fluorocarbon-rich phase are further fluorinated and separation of perfluoro-n-heptane from the second stage effluent by simple fractionation.

8 Claims, 1 Drawing Figure

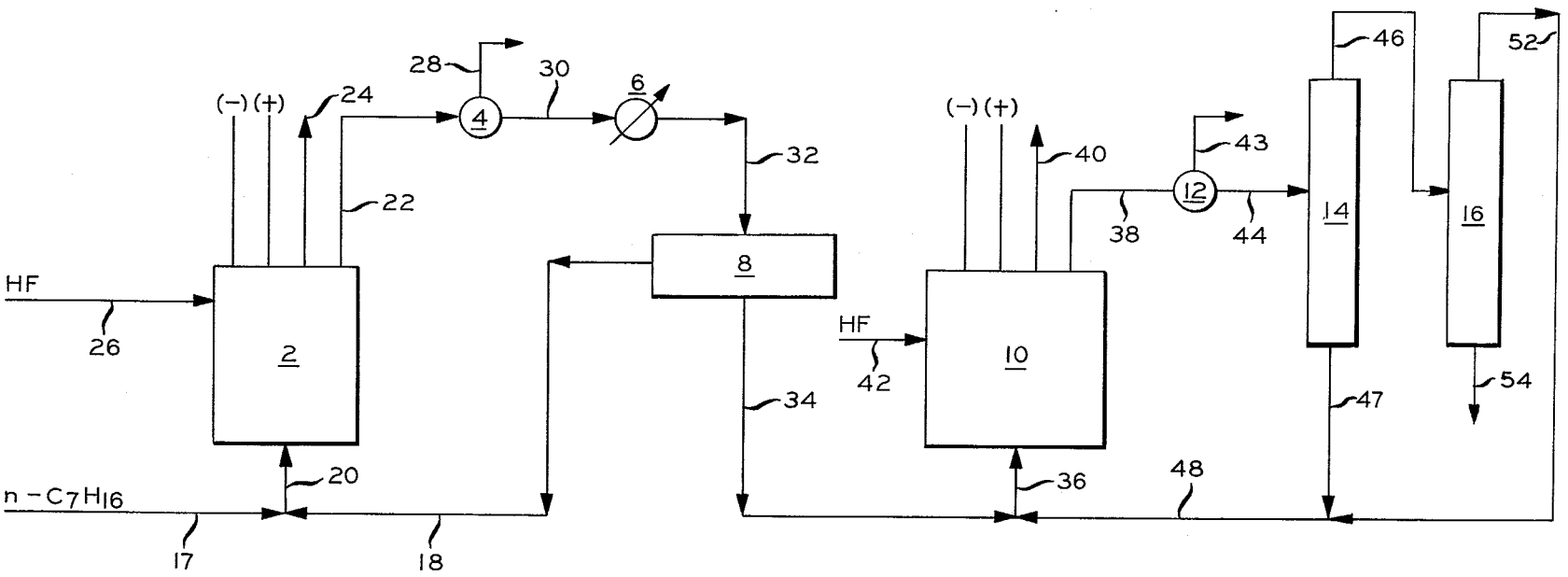
52
16
54
46
14
47
43
12
44
48
38
40
10
36
(−) (+)
HF
42
32
8
34
6
30
4
28
18
22
24
2
20
(−) (+)
17
26
HF
n − C7H16

PRODUCTION OF PERFLUORO-N-HEPTANE

This invention relates to a process for the production of perfluoro-n-heptane.

Electrochemical fluorination processes for preparing or converting organic compounds into desirable fluorinated compounds are generally known in the art. Recent advances in the state of the art include electrochemical fluorination processes wherein fluorination of organic compounds is carried out within the confines of a porous anode. Such an improved process is capable of producing a broad variety of partially and completely fluorinated products with very little carbon to carbon bond scission which results in undesirable byproducts.

In such prior art electrolytic fluorination processes, when charging n-heptane feedstock, there is obtained a mixture of partially and completely fluorinated n-heptanes. There is also the problem that mixtures of perfluoro-n-heptane and unconverted n-heptane cannot readily be separated, since perfluoro-n-heptane and n-heptane form a 1:1 azeotrope. As a result, it is difficult to obtain a perfluoro-n-heptane product that is not contaminated with significant amounts of n-heptane. Perfluoro-n-heptane, uncontaminated by n-heptane and/or partially fluorinated intermediates, is an essential ingredient of blood substitute. Perfluoro-n-heptane is also used in liquid lens optical systems.

The phrase "partially fluorinated heptanes" as used herein, refers to fluorinated n-heptane molecules containing at least one but not more than 15 fluorine atoms. The phrase is used interchangeably with "perfluoro-n-heptane intermediates", "perfluoro intermediates" or simply "intermediates".

It is an object of this invention to provide an improved electrochemical process for the fluorination of n-heptane to perfluoro-n-heptane.

Another object is to provide an improved electrochemical process for the continuous fluorination of n-heptane and the recovery of perfluoro-n-heptane which avoids or substantially reduces the separtion of perfluoro-n-heptane from unconverted n-heptane feedstock.

Other objects and advantages of the present invention will be apparent to those skilled in the art in view of this disclosure and the appended drawings and claims.

In accordance with the present invention there is provided a process for the electrochemical fluorination of n-heptane to perfluoro-n-heptane which comprises:

a. passing n-heptane into a first electrochemical fluorination zone and therein fluorinating at least a portion of the n-heptane under conditions sufficient to produce an effluent stream comprising unconverted n-heptane, partially fluorinated n-heptane and perfluoro-n-heptane;

b. passing the effluent to a cooling zone wherein the stream is cooled to a temperature sufficient to condense the n-heptane, partially fluorinated n-heptanes and the perfluoro-n-heptane;

c. passing the resulting condensed stream to a phase separation zone and separating therefrom a hydrocarbon-rich phase comprising n-heptane and fluorinated heptanes, and a fluorocarbon-rich phase comprising perfluoro-n-heptane, perfluoro intermediates and n-heptane;

d. passing the fluorocarbon-rich phase into a second electrochemical fluorination zone and therein fluorinating at least a portion of the n-heptane and perfluoro intermediates under conditions sufficient to produce a second effluent stream comprising partially fluorinated n-heptanes, perfluoro-n-heptane and a small amount of n-heptane; and e. passing the second effluent stream to a fractionation zone and separating therefrom a product stream consisting essentially of perfluoro-n-heptane.

The invention is applicable to any electrochemical fluorination process employing an electrolyte comprising essentially anhydrous hydrogen fluoride. The presently preferred electrochemical fluorination process comprises passing the n-heptane or the perfluoro-n-heptane intermediates into the pores of a porous anode at a point near the bottom of the porous anode, e.g., porous carbon, immersed in a current conducting, essentially anhydrous hydrogen fluoride-containing liquid electrolyte such as KF-2HF. The feedstock contacts the fluorinating species within the pores of the anode and, depending on the conditions, at least a portion of the hydrogen on the n-heptane or the intermediates is replaced with fluorine. The fluorinated products leave the pores of the anode and exit the cell. Hydrogen is generated at the cathode and, with the aid of a simple cell divider, the majority of the hydrogen can be withdrawn from the cell without mingling with the fluorination products. HF is consumed in the process and is continuously or intermittently replaced.

Further details of suitable electrochemical fluorination cells can be found in Ashe et al., U.S. Pat. No. 3,711,396.

The hydrogen fluoride electrolyte can contain small amounts of water, such as up to about 5 weight percent. However, it is preferred that the electrolyte be essentially anhydrous, e.g., contain not more than about 0.1 weight percent water. Commercial anhydrous hydrogen fluoride containing up to about 1 weight percent water can be used. Thus, as used herein, and in the claims, unless otherwise specified, the term "essentially anhydrous liquid hydrogen fluoride" includes liquid hydrogen fluoride which can contain water not exceeding about 1 percent by weight. As the electrolysis reaction proceeds, any water contained in the hydrogen fluoride electrolyte is slowly decomposed and the electrolyte concomitantly approaches the anhydrous state. Pure anhydrous hydrogen fluoride is nonconductive; therefore, to provide adequate conductivity in the electrolyte, and to reduce the hydrogen fluoride vapor pressure at cell operating conditions, an inorganic additive can be incorporated in the electrolyte. Presently preferred additives for this purpose are the alkali metal fluorides and ammonium fluoride. The additives can be employed in any suitable molar ratio of additive to hydrogen fluoride, generally within the range of 1:4.5 to 1:1.

Generally speaking, the fluorination process can be carried out at temperatures within the range of −80° to +500° C, at which the vapor pressure of the electrolyte is not excessive, e.g., less than 250 mm. Hg. It is preferred to operate at temperatures such that the vapor pressure of the electrolyte is less than about 50 mm. Hg. Preferred operating temperatures are in the range of about 60° to 120° C.

Pressures substantially above or below atmospheric can be employed; however, the vapor pressure of the electrolyte must be taken into consideration as discussed above. Generally speaking, the process is conveniently carried out at substantially atmospheric pressure.

Current densities in the range of 30 to 1000 or higher, preferably 50 to 500, milliamps per square centimeter of anode geometric surface can be used. The voltage which is normally used will vary depending upon the particular cell configuration and the current density desired. Voltages in the range of 4 to 12 volts are typical. Generally speaking, the maximum normal voltage will not exceed 20 volts per unit cell. The term "anode geometric surface" refers to the outer geometric surface area of the anode which is exposed to the electrolyte and, in the case of porous anodes, does not include the pore surface of such porous element.

Feed rates which can be employed will preferably be within the range of from 0.5 to 10 ml. per minute per square centimeter of anode geometric surface area. Since the anode can have a wide variety of geometrical shapes, which will effect the geometrical surface area, it is sometimes more useful to express the feed rate in terms of anode cross-sectional area, taken perpendicular to the direction of flow. In this latter case, the feedstock flow rate can be within the range of from 3 to 600 milliliters per minute per square centimeter of anode cross-section area. All the above flow rates are expressed in terms of gaseous volume at standard conditions.

Further details of suitable electrochemical processes can be found in Fox et al, U.S. Pat. No. 3,511,760 and Childs, U.S. Pat. No. 3,511,762.

Referring now to the drawing, the sole FIGURE is a simplified diagrammatic representation of the process of the present invention.

In the FIGURE, there are represented, in combination, cell zone 2, degassing zone 4, cooling zone 6, phase separation zone 8, cell zone 10, degassing zone 12, first fractionation zone 14 and second fractionation zone 16. Cell zones 2 and 10 each represent one or more cells which can be connected in series or parallel and are suitable for electrochemical fluorination.

In operation, n-heptane feed in line 17 is mixed with recycle materials in line 18 and passed into cell zone 2 through line 20. The fluorinated products exit the cell zone through line 22. At least a portion of the hydrogen can exit the cell zone 2 through line 24. Hydrogen fluoride feed is passed, as required, into cell zone 2 through line 26.

The fluorinated mixture in line 22, comprising perfluoro-n-heptane, intermediates, unconverted n-heptane, hydrogen and some hydrogen fluoride is conducted to degassing zone 4 where the hydrogen is removed through line 28. Degassing zone 4 can be a simple fractionator, flash, or the like. The resulting degassed mixture is passed through line 30 to cooling zone 6 where the mixed stream is cooled to a temperature sufficient to condense the n-heptane, intermediates and the perfluoro-n-heptane. In general, cooling the mixture to about 20°–30° C, or lower, will be sufficient.

The cooling mixture is passed through line 32 to phase separation zone 8. A hydrocarbon-rich upper liquid phase is withdrawn from separation zone 8 through line 18 and combined with fresh n-heptane in line 20. A fluorocarbon-rich lower liquid phase is withdrawn from separation zone 8 and passed through lines 34 and 36 to cell zone 10. The fluorinated products exit cell zone 10 through line 38. At least a portion of the hydrogen can exit cell zone 10 through line 40. Hydrogen fluoride feed is passed, as required, into cell zone 10 through line 42.

The fluorinated mixture in line 38, comprising perfluoro-n-heptane, intermediates, a small amount of unconverted n-heptane, hydrogen and hydrogen fluoride is passed to degassing zone 12 where the hydrogen is removed through line 43. The resulting degassed mixture is passed through line 44 to first fractionating zone 14. An overhead stream 46 consisting essentially of a major amount of perfluoro-n-heptane together with a minor amount of a low-boiling n-haptane/perfluoro-n-heptane azeotrope and a minor amount of hydrogen fluoride is withdrawn from first fractionating zone 14 and passed to second fractionating zone 16. Intermediates leave first fractionating zone 14 through line 47 and can be recycled to cell zone 10 through lines 48 and 36 for conversion to additional perfluoro-n-heptane.

Perfluoro-n-heptane is recovered in high purity from stream 46 by passage through second fractionating zone 16 wherein the low-boiling azeotrope is taken overhead, together with the hydrogen fluoride, as stream 52. Stream 52 can be recycled to the cell zone 10 through lines 48 and 36. High purity perfluoro-n-heptane is recovered as bottoms stream 54 from second fractionation zone 16. Separation of the perfluoro-n-heptane from the n-heptane/perfluoro-n-heptane azeotrope is possible because the effluent 38 from cell zone 10 is on the perfluoro-n-heptane-rich side of the azeotrope.

The following calculated example will serve to further illustrate the invention. The conditions set forth for the operation of the electrochemical fluorination cell are based upon numerous laboratory and pilot plant runs carried out for the electrochemical fluorination of n-heptane, and on recovery of perfluoro-n-heptane.

EXAMPLE

In this illustrative embodiment a run is carried out for the electrochemical fluorination of n-heptane in a system embodying the essential features of the system illustrated in the drawing and using an electrolyte in cells 2 and 10 having an approximate molar composition of KF-2HF, with the exception that the streams in lines 18 and 48 are not recycled to respective cells 2 and 10. Porous carbon anodes having a diameter of 1.375 inches (3.49 cm) and 9 inches (22.86 cm) of length immersed in electrolyte are employed in cells 2 and 10. Fresh n-heptane feedstock is introduced through lines 17 and 20 into the pores of the anode of cell 2. During steady-state operation, the conversion in cell 2 is carried out at an electrolyte temperature of about 93° C, employing a current density of about 179 milliamperes per square centimeter of outer carbon anode surface at a feed rate of 8.93 grams of n-heptane per hour. The system pressure is substantially atmospheric. A cell effluent stream is withdrawn via line 22 and processed substantially as described above in connection with the drawing, with the exceptions noted above. Cell 10 is like cell 2. During steady-state operation, the conversion in cell 10 is carried out at an electrolyte temperature of about 93° C, employing a current density of about 30.5 milliamperes per square centimeter of outer carbon anode surface. The following table set forth the principal components of each stream and a calculated material balance for the system.

Table

| Component | Stream Number, Grams per Hour | | | | | | | | | | | | |
|---|---|---|---|---|---|---|---|---|---|---|---|---|---|
| | 20 | 26 | 22 | 28 | 18 | 34 | 42 | 38 | 43 | 46 | 47 | 52 | 54 |
| n-Heptane | 8.93 | | | | | | | | | | | [6] | |
| Hydrogen Fluoride | | 24.00 | 4.00 | | 3.00 | 1.00 | 0.68 | 0.36 | | 0.36 | | 0.36 | |
| Hydrogen | | | 2.00 | 2.00 | | | | 0.34 | 0.34 | | | | |
| Intermediates* | | 26.93[1] | | 14.68[2] | 12.25[3] | | 15.34[4] | | | 11.90 | | | |
| Perfluoro-n-heptane | | | | | | | | | | 3.44[5] | | [6] | 3.40 |

*includes perfluoro-n-heptane and n-heptane, except for stream 47 which contains no n-heptane.
[1]Contains about 14 mole percent perfluoro-n-heptane and an unmeasured, amount of n-heptane.
[2]Contains about 70 mole percent n-heptane and 30 mole percent intermediates.
[3]Contains about 6 mole percent n-heptane and 94 mole percent fluorinated heptanes including perfluoro-n-heptane.
[4]Contains about 25 mole percent perfluoro-n-heptane and a small, unmeasured, amount of n-heptane.
[5]Contains small amounts of n-heptane as an azeotrope with perfluoro-n-heptane and low-boiling feed degradation products.
[6]A small amount of n-heptane/perfluoro-n-heptane azeotrope.

From the data set forth above, it can be seen that the invention provides an efficient method for the separation and recovery of perfluoro-n-heptane from a cell effluent stream in the electrochemical fluorination of n-heptane. More particularly, the data illustrate the ease of separation of the product perfluoro-n-heptane from unreacted n-heptane feedstock by simple distillation in spite of the fact that these two components form an azeotrope. This was accomplished by using the two cells in such a manner that the second cell effluent was on the perfluoro-n-heptane-rich side of the azeotrope, thus permitting distillation of the desired perfluoro product.

Reasonable variations and modifications, which will be apparent to those skilled in the art, can be made in this invention without departing from the spirit and scope thereof.

We claim:

1. A process for the electrochemical fluorination of n-heptane to perfluoro-n-heptane which comprises in combination, the steps of:

a. passing n-heptane into a first electrochemical fluorination cell zone and therein fluorinating at least a portion of said n-heptane under conditions sufficient to produce a first effluent stream comprising unconverted n-heptane, partially fluorinated n-heptanes and perfluoro-n-heptane;

b. passing said first effluent stream to a cooling zone wherein said stream is cooled to a temperature sufficient to condense said n-heptane, said partially fluorinated-n-heptanes and said perfluoro-n-heptane;

c. passing the resulting condensed stream to a phase separation zone and separating therefrom a hydrocarbon-rich phase comprising n-heptane and partially fluorinated n-heptanes, and a fluorocarbon-righ phase comprising perfluoro-n-heptane, partially fluorinated n-heptanes and n-heptane;

d. passing said fluorocarbon-rich phase into a second electrochemical fluorination cell zone and therein fluorinating at least a portion of said n-heptane and said partially fluorinated n-heptanes under conditions sufficient to produce a second effluent stream comprising partially fluorinated n-heptanes, perfluoro-n-heptane and a small amount of n-heptane;

e. passing said second effluent stream to a first fractionation zone and recovering therefrom an overhead stream consisting essentially of a major amount of perfluoro-n-heptane together with a minor amount of hydrogen fluoride and a minor amount of an n-heptane/perfluoro-n-heptane azeotrope, and a bottoms stream comprising partially fluorinated n-heptanes; and f. passing said first fractionation zone overhead stream to a second fractionation zone and recovering therefrom an overhead stream consisting essentially of said azeotrope and said hydrogen fluoride, and a bottoms product stream consisting essentially of perfluoro-n-heptane.

2. The process of claim 1 wherein said first effluent stream and second effluent stream are degassed to remove hydrogen.

3. The process of claim 1 wherein said hydrocarbon-rich phase is recycled to said first cell zone.

4. The process of claim 1 wherein said first fractionation zone bottoms stream is recycled to said second cell zone.

5. The process of claim 1 wherein at least one of said first cell zone and said second cell zone is provided with a porous anode.

6. The process of claim 1 wherein at least one of said first and second cell zones employs an essentially anhydrous, liquid hydrogen fluoride electrolyte having the approximate composition KF-2HF.

7. The process of claim 1 wherein said first effluent stream is cooled to a temperature below about 30° C.

8. The process of claim 1 wherein said second fractionation zone overhead is recycled to said second cell zone.

* * * * *